US009272435B2

(12) United States Patent
Bohne

(10) Patent No.: US 9,272,435 B2
(45) **Date of Patent: *Mar. 1, 2016**

(54) TOOL FASTENABLE TO A DRIVE SHAFT OF A HAND-HELD POWER TOOL DRIVEABLE IN OSCILLATING MANNER

(71) Applicant: ROBERT BOSCH GMBH, Stuttgart-Feuerbach (DE)

(72) Inventor: Ulrich Bohne, Kohlberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/154,322

(22) Filed: Jan. 14, 2014

(65) Prior Publication Data

US 2014/0123825 A1 May 8, 2014

Related U.S. Application Data

(63) Continuation of application No. 13/371,600, filed on Feb. 13, 2012, now Pat. No. 8,640,580, which is a continuation of application No. 10/574,683, filed as application No. PCT/EP2005/054126 on Aug. 23, 2005, now Pat. No. 8,151,679.

(30) Foreign Application Priority Data

Oct. 19, 2004 (DE) ..... 10 2004 050 798

(51) Int. Cl.
*B26D 7/26* (2006.01)
*B24B 23/04* (2006.01)
(Continued)

(52) U.S. Cl.
CPC ..... *B26D 7/2614* (2013.01); *B24B 23/04* (2013.01); *B24B 45/00* (2013.01); *B27B 5/32* (2013.01); *B27B 19/006* (2013.01); *Y10T 29/49963* (2015.01); *Y10T 83/04* (2015.04);
(Continued)

(58) Field of Classification Search
CPC ..... B24B 23/04; B24B 45/00; B27B 5/32
USPC ..... 83/698.11, 698.41, 782, 651; 30/144; 403/3, 13, 260; 606/79, 82, 176–179, 606/170, 171
See application file for complete search history.

(56) References Cited

U.S. PATENT DOCUMENTS 3,905,374 A * 9/1975 Winter ..... 606/178
3,943,934 A 3/1976 Bent
(Continued)

FOREIGN PATENT DOCUMENTS

DE 30 12 836 10/1981
DE 201 17 159 2/2002
(Continued)

*Primary Examiner* — Omar Flores Sanchez
(74) *Attorney, Agent, or Firm* — Michael J. Striker

(57) ABSTRACT

A tool for use with is configured with a tool centering element and a fastening portion with form-locking elements for axial mounting and fastening onto a drive shaft of a hand-held power tool. The drive shaft is drivable in oscillating fashion and the centering element centers the tool relative to the drive shaft. The tool form-locking elements define a rotary position of the tool relative to the drive shaft. The centering element may be a through-hole in a fastening portion of the tool or, may be a fastening screw that passes through an axially centered through hole in the fastening portion to the tool for securing the toll and fastening screw in a bore within the drive shaft to which the tool is attached for intended operation.

23 Claims, 3 Drawing Sheets

(51) Int. Cl.
*B24B 45/00* (2006.01)
*B27B 5/32* (2006.01)
*B27B 19/00* (2006.01)

(52) U.S. Cl.
CPC ..... *Y10T 83/7045* (2015.04); *Y10T 83/9379* (2015.04); *Y10T 83/9454* (2015.04); *Y10T 83/9457* (2015.04); *Y10T 83/9464* (2015.04); *Y10T 403/18* (2015.01); *Y10T 403/75* (2015.01)

(56) References Cited

U.S. PATENT DOCUMENTS 4,252,121 A * 2/1981 Arnegger ..... 606/53
5,122,142 A 6/1992 Pascaloff
5,178,626 A 1/1993 Pappas
5,366,312 A * 11/1994 Raines ..... 403/3
5,489,285 A 2/1996 Goris
6,723,101 B2 4/2004 Fletcher et al.
6,796,888 B2 * 9/2004 Jasch ..... 451/342
6,802,764 B2 10/2004 Besch
7,789,885 B2 * 9/2010 Metzger ..... 606/88
7,833,241 B2 * 11/2010 Gant ..... 606/176
7,837,690 B2 * 11/2010 Metzger ..... 606/87
7,887,542 B2 * 2/2011 Metzger et al. ..... 606/87
8,123,758 B2 * 2/2012 Metzger et al. ..... 606/102
8,151,679 B2 4/2012 Bohne
8,640,580 B2 2/2014 Bohne
2002/0070037 A1 6/2002 Jasch

FOREIGN PATENT DOCUMENTS

EP 1 034 870 9/2000
WO 2006/042768 4/2006

* cited by examiner

TOOL FASTENABLE TO A DRIVE SHAFT OF A HAND-HELD POWER TOOL DRIVEABLE IN OSCILLATING MANNER

CROSS-REFERENCE TO RELATED APPLICATION

The invention described and claimed hereinbelow ("the Instant Continuation Application") is a continuation application of U.S. patent application Ser. No. 13/371,600, filed in the US on Feb. 13, 2012 ("the Parent Application"); the Parent Application is a continuation application of U.S. patent application Ser. No. 10/574,683, filed in the US on Apr. 4, 2006 and issued as U.S. Pat. No. 8,151,679 on Apr. 10, 2012 ("the Grandparent Application"). The Grandparent Application is a 371 of PCT/EP 2005/054126 filed on Aug. 23, 2005 which claims priority and is described in German Patent Application DE 10 2004 050 798.8, filed in Germany on Oct. 19, 2004 "the German Patent Application). The Instant Continuation Application derives its basis for priority under 35 USC §119 (a)-(d) from the Parent Application, the Grandparent Application and the German Patent Application, the subject matter of all of which being incorporated by reference herein.

BACKGROUND OF THE INVENTION

The invention is based on a device for fastening an axially mountable tool to a drive shaft, drivable in oscillating fashion, of a hand-held power tool, as generically defined by the preamble to claim 1.

From European Patent Disclosure EP 1 213 107 A1, a device for fastening an axially mountable tool to a drive shaft, drivable in oscillating fashion, of a hand-held power tool, is known. This device includes a centering recess and six form-locking elements, which are embodied as tips in an outline of their centering recess and are therefore part of the centering recess.

SUMMARY OF THE INVENTION

The invention is based on a device having a centering element and at least one form-locking element for fastening an axially mountable tool to a drive shaft, which is drivable in an oscillating manner, of a hand-held power tool in which the centering element is provided for centering the tool relative to the drive shaft, and the form-locking element is provided for defining a rotary position of the tool relative to the drive shaft.

It is proposed that the form-locking element is located radially outside the centering element. As a result, an advantageous separation of a centering function from a defining function and/or a torque transmission function can be achieved, so that a more-comfortable fastening process is attainable. Because the form-locking element is located radially on the outside, an advantageously long lever for transmitting torque can be achieved, with comparatively little material stress in the region of the form-locking element, without losing precision in a centering operation.

The term "intended" is to be understood in this respect to mean "designed" and "equipped".

In an embodiment of the invention, it is proposed that the centering element has a circular cross section. As a result, it can be attained that after the centering operation, the rotary position is freely selectable and is independent of the centering operation. The centering element can be embodied either as a circular recess or as a bolt with a circular cross section.

A sturdier and more secure form lock can be attained if the form-locking element is intended for engagement in a recess.

However, embodiments of the invention are also conceivable in which the form-locking element is formed by a set of teeth, for instance, and is intended to mesh with a corresponding set of teeth. A more-secure hold of the form-locking element is attainable if the form-locking element has at least one axially extending bearing face.

If the form-locking element is intended for fastening the tool in at least three rotary positions, then the device can advantageously be suitable for fastening a tool with three possible working positions, in particular a tool with triple symmetry, for instance a triangular grinding plate.

If the form-locking element is intended for fastening the tool in at least four rotary positions, then the device can advantageously be intended for fastening a tool with four possible working positions, and particularly for fastening a tool with quadruple symmetry or with working positions that differ by 90°. As an example, a circular saw blade can be named.

A device that can be used universally for many different kinds of tools can be attained if the form-locking element is intended for fastening the tool in at least twelve rotary positions. Especially if the rotary positions are distributed uniformly over an angular range, flexible adjustment with simultaneously more-secure torque transmission is attainable.

A rotationally symmetrical device is attainable if the angular range amounts to 360°. Especially in the case of a twelve-fold rotational symmetry, a device that can advantageously be used for tools both with triple symmetry and with quadruple symmetry is attainable, which is suitable especially both for fastening a triangular grinding plate and a circular saw blade.

Torque transmission with little material stress and simultaneously more-precise centering of the tool can be attained if a radius associated with one position of the form-locking element is more than twice as large as a radius of the centering element. If a plurality of form-locking elements is located on a circle, the radius of the circle can be associated with the form-locking elements, and otherwise, the radial spacing of the form-locking element or one edge of it, from an axis of rotation of the drive shaft can be associated with them.

An economical, safe form-locking element is attainable if the form-locking element is embodied in pin-like form.

If the device has a plurality of identically shaped form-locking elements, distributed uniformly over a circle around the centering element, then an asymmetrical load on the device upon torque transmission can be avoided.

Point-wise stress on material can be avoided if the form-locking element has at least one slaving face, oriented substantially in the circumferential direction. The direction of the face is determined by the surface normal. A precise-fitting slaving face, or a bearing face corresponding to the slaving face, can be attained structurally simply if the slaving face is embodied as flat. Comfortable guidance into an engagement rotary position of the form-locking element is attainable if the form-locking element has at least one chamfer for reinforcing a slip-on operation.

Play-free fastening can be attained and an overload on the device can be avoided if the device includes a spring element for generating a clamping force on the tool. A set-point torque of the device can be made clearer to a user if a blocking force of the spring element is associated with a rated torque of a fastening element, in particular a screw.

A cost-saving device can be attained if the centering element is embodied as a fastening screw.

If the spring element is embodied as a cup spring, it can advantageously be capable of being manufactured inexpensively, and the contact-pressure flange can be useful for axially pressing the tool against the drive shaft.

Sufficiently precise centering with adequate stability is attainable if the diameter of the centering element amounts to between 4 and 8 mm.

The invention is also based on a tool, having a centering element and a form-locking element for axial mounting and fastening onto a drive shaft, drivable in oscillating fashion, of a hand-held power tool, in which the centering element is intended for centering relative to the drive shaft and the form-locking element is intended for defining a rotary position relative to the drive shaft.

It is proposed that the form-locking element is located radially outside the centering element. As a result, a tool can be attained that can be fastened in a fastening operation to the drive shaft, which operation includes an operation, independent of the centering operation, for determining the rotary position.

A secure form-locking connection between the tool and the drive shaft is attainable if at least one corresponding form-locking element of the drive shaft is associated with the form-locking element.

An especially economical replaceable tool can be attained if the form-locking element is embodied as a recess. However, embodiments of the invention are also conceivable in which the form-locking element is embodied as a raised bulge that engages a recess on the drive shaft.

BRIEF DESCRIPTION OF THE DRAWINGS

Further advantages will become apparent from the ensuing description of the drawings. In the drawings, exemplary embodiments of the invention are shown. The drawings, description and claims include numerous characteristics in combination. One skilled in the art will expediently consider these characteristics individually as well and put them together to make useful further combinations.

DESCRIPTION OF THE INVENTION

Figure 1:
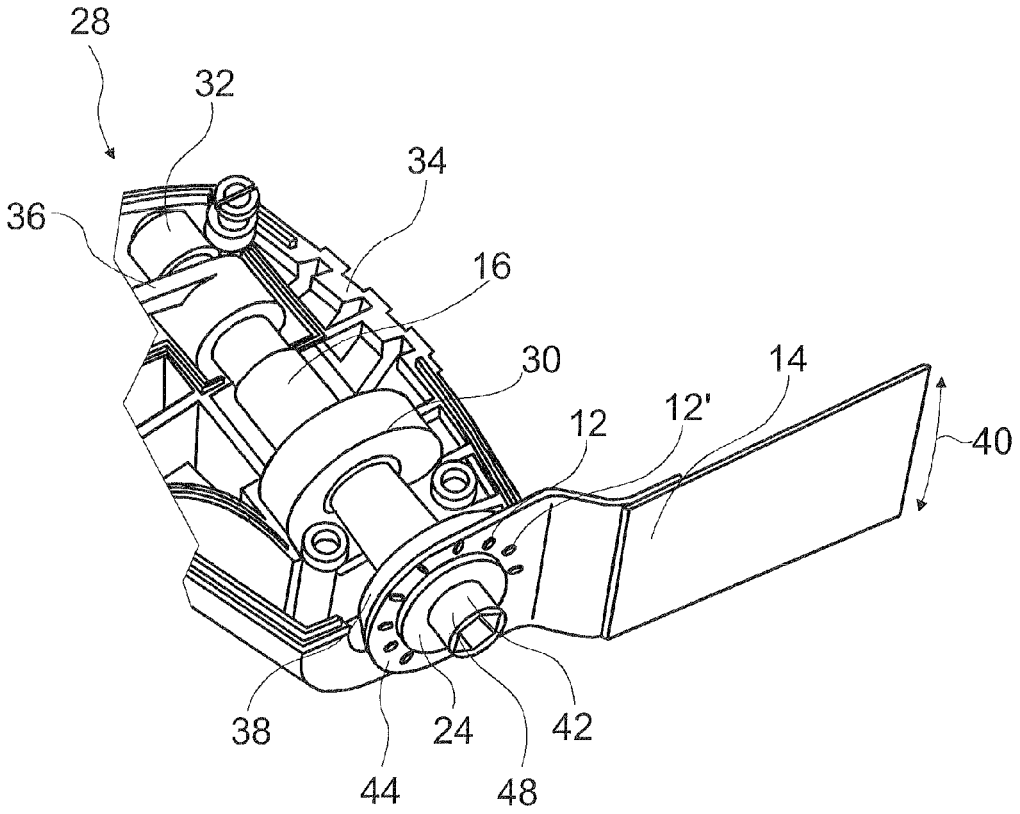
FIG. 1 depicts a hand-held power tool with a centering element and a form-locking element for fastening an axially mountable tool.

FIG. 1 shows a hand-held power tool 28 with a drive shaft 16 which is drivable in oscillating fashion and is supported, via a ball bearing 30 and a needle bearing 32, in a housing 34 of the hand-held power tool 28, half of the housing having been removed in the drawing. The hand-held power tool 28 includes an electric motor, not shown here, which via a motor shaft drives an eccentric disk the inside of which is engaged by an arm 36, connected to the drive shaft 16 in a manner fixed against relative rotation, so that a rotary motion of the eccentric disk generates an oscillatory motion of the arm 36 and thus of the drive shaft 16.

On an end of the drive shaft 16 protruding from the housing 34, the hand-held power tool 28 has a device for fastening an axially mountable tool 14, which device includes a plate-like bearing flange 38, a fastening screw 42, and a spring element 24 embodied as a cup spring. The device serves to provide a rotationally and axially fixed connection between the tool 14 and the drive shaft 16, so that the oscillating motion of the drive shaft 16 is converted into an oscillating pivoting motion 40 of the tool 14.

The bearing flange 38 has a circular bearing face, which extends perpendicular to the drive shaft 16 and on which a total of twelve pin-like form-locking elements 12 of trapezoidal cross section are distributed uniformly over an angular range that is defined by the entire circumference of the circle. In the middle of the bearing flange 38, a centering element 10 (FIG. 2) embodied as a blind bore is mounted, with a female thread, not shown here, for receiving the fastening screw 42.

Figure 4:
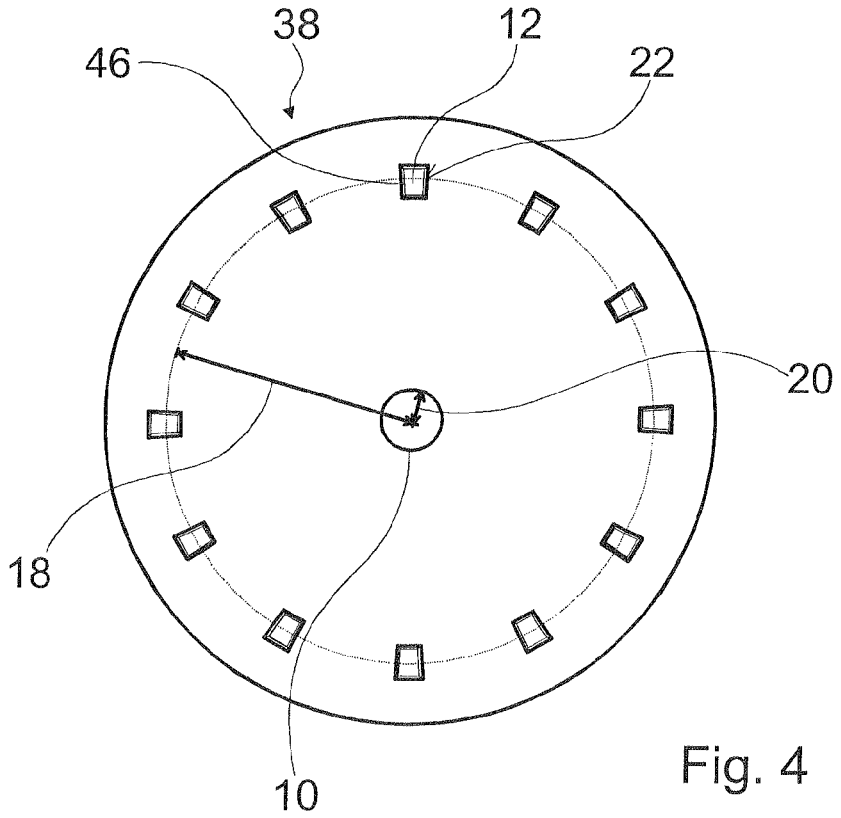
FIG. 4 depicts a bearing flange of the hand-held power tool of FIGS. 1 through 3.

The form-locking elements 12 are located radially outside the centering element 10. The radius 18 of the circle on which the form-locking elements 12 are located exceeds the radius 20 of the centering element 10 by a factor of four. The form-locking elements 12 have lateral slaving faces 22, which extend radially outward, relative to the axis of rotation of the drive shaft 16, as well as axially. On an edge facing away from the body of the hand-held power tool 28, the form-locking elements 12 also have a chamfer 46 for reinforcing a slip-on operation of the tool 14 (FIG. 4).

Figure 3:
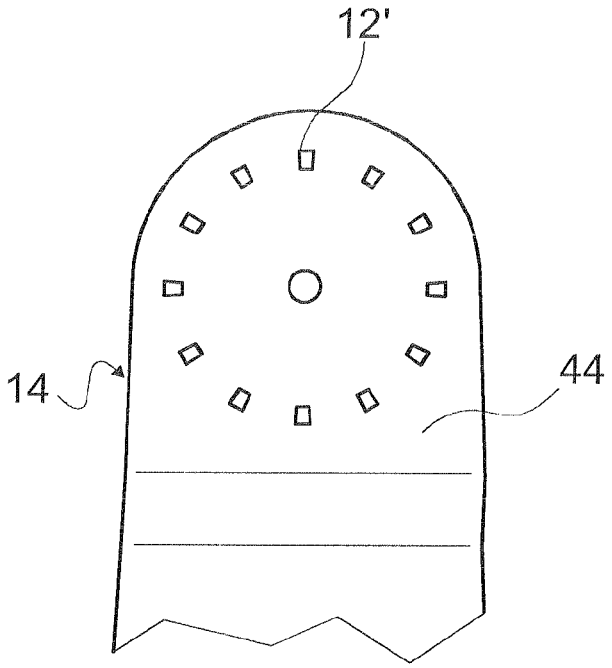
FIG. 3 depicts a detail of the tool of FIGS. 1 and 2.

The tool 14 is part of a large assortment of possible insert tools, which includes circular saw blades, milling cutters, grinding plates, and cutting tools. In a fastening portion 44, which is identical in all the tools of the assortment, the tool 14 has twelve form-locking elements 12', located in a circle and embodied as recesses or holes, which correspond to the form-locking elements 12 on the bearing flange 38. The form-locking elements 12' have a shape that corresponds to the trapezoidal cross section of the form-locking elements 12 (FIG. 3).

In an installed state of the tool 14, the form-locking elements 12 reach through the form-locking elements 12' and define a rotary position of the tool 14 relative to the drive shaft 16. Because of the twelve-fold symmetry of the arrangement of form-locking elements 12, 12', the device is suitable for defining twelve different rotary positions of the tool 14 relative to the drive shaft 16, and these positions differ from each of their adjacent rotary positions by 30° each. Each rotary position corresponds to a different association between the form-locking elements 12 and the form-locking elements 12'.

Figure 2:
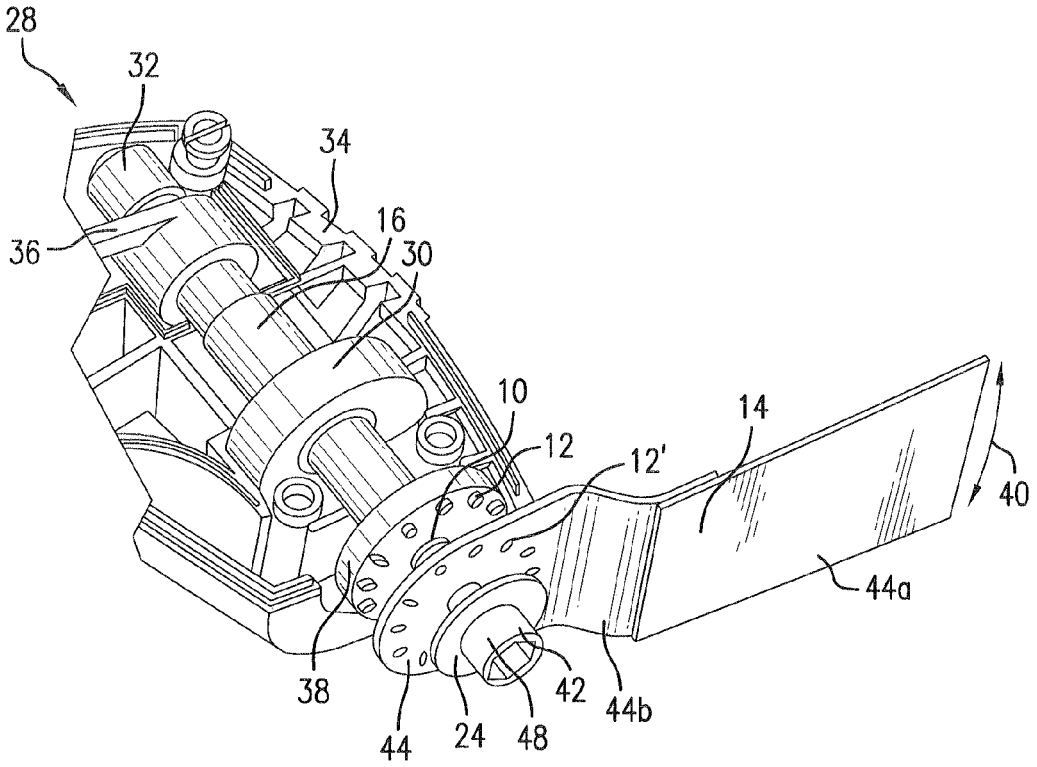
FIG. 2 depicts the hand-held power tool of FIG. 1 in a configuration of a centering operation.

In the center of the fastening portion 44 and of the circle on which the form-locking elements 12' are located, the tool 14 has a round hole, whose diameter amounts to 6 mm and thus corresponds to the diameter of a shaft of the fastening screw 42. The fastening portion 44 is arranged in parallel to a second tool part 44*a* that is connected to fastening section 44 via an inclined section 44*b* (FIG. 2).

During an installation operation, a user pushes the fastening screw 42, provided with the spring element 24, through the round hole in the fastening portion 44 and introduces the fastening screw 42 into the centering element 10, embodied as a blind bore, in the bearing flange 38. A head 48 of the fastening screw 42 has a hexagonal recess for receiving a hex wrench.

By screwing the fastening screw 42 into the centering element 11, the tool 14 is displaced past the spring element 24, acting as a contact-pressure flange, in the direction of the bearing flange 38, until the tool 14 comes into contact with the form-locking elements 12. By rotating the tool 14, the user can now determine the rotary position relative to the drive shaft 16. In the process, by a contact pressure generated by the spring element 24, the tool 14 is automatically deflected past the chamfers 46 of the form-locking elements 12 into one of the twelve rotary positions in which the tool 14 can be fixed. Centering of the tool 14 is made more precise by the intermeshing of the form-locking elements 12, 12', and especially by the contact of a radially inward-pointing side face of the form-locking elements 12 with a radially inner edge of the form-locking elements 12'.

Once the form-locking elements 12 have entered into engagement with the form-locking elements 12', the user tightens the fastening screw 42 further, until the tool 14 is pressed by the spring element 24 against the bearing face of the bearing flange 38. The spring element 24 becomes fully compressed once a rated torque of the fastening screw 42 is attained, which is perceptible to the user from a sudden increase in a torque required to turn the fastening screw 42. The spring element 24 then generates a clamping force, dictated essentially by the blocking force, with which clamping force the tool 14 is held without play on the bearing face of the bearing flange 38.

What is claimed is:

1. A blade for mounting on a drive shaft of a hand-held power tool, the blade comprising:

a working portion; and a fastening portion including blade form-locking elements for axial mounting and fastening the blade onto a drive shaft of the hand-held power tool; and a blade centering element configured to center the blade relative to a drive shaft of the hand-held power tool, the blade centering element is embodied as an opening that passes through the blade;

wherein the fastening portion forms a first blade part arranged in parallel to the working portion, which forms a second blade part;

wherein the second blade part is permanently connected to the first blade part via an inclined section of the blade, said inclined section is arranged relative to the fastening portion by an angle other than 90°;

wherein said blade form-locking elements are located radially outside said blade centering element in a circular arrangement, are defined as openings that pass through the blade, have a quadrangular cross section for corresponding to a trapezoidal cross section of flange form-locking elements of the hand-held power tool, are distributed uniformly over an angular range that is defined by an entire circumference of the circular arrangement, are configured to define a plurality of different, adjacent rotary positions, relative to the drive shaft of the hand-held power tool, and comprise at least one slaving face that is flat.

2. The blade as recited in claim 1, wherein the blade centering element has a closed circular cross-section.

3. The blade as recited in claim 1, wherein the blade form-locking elements are spaced apart from the blade centering element.

4. The blade as recited in claim 1, wherein there are twelve blade form-locking elements for corresponding to twelve drive shaft form-locking elements.

5. The blade as recited in claim 1, wherein the adjacent rotary positions are separated by 30° intervals.

6. The blade as recited in claim 1, wherein a bearing face on the fastening portion on which the blade form-locking elements are disposed corresponds to a slaving face of a flange on which the drive shaft form-locking elements are disposed.

7. The blade as recited in claim 6, wherein a radius of the blade form-locking elements is four times as large as a radius of the blade centering element.

8. The blade as recited in claim 1, wherein the blade form-locking elements are embodied as raised bulges that engage corresponding recesses on the drive shaft.

9. A blade for mounting on a drive shaft of a hand-held power tool, the blade comprising:

a working portion; and a fastening portion including blade form-locking elements for axial mounting and fastening the blade onto a drive shaft of the hand-held power tool; and a blade centering element configured to center the blade relative to a drive shaft of the hand-held power tool, the blade centering element is embodied as an opening that passes through the blade and have having a closed circular cross-section;

wherein the fastening portion forms a first blade part arranged in parallel to the working portion, which forms a second blade part;

wherein the second blade part is permanently connected to the first blade part via an inclined section of the blade;

wherein said blade form-locking elements are located radially outside said blade centering element in a circular arrangement, are defined as openings that pass through the blade, have a quadrangular cross section for corresponding to a trapezoidal cross section of flange form-locking elements of the hand-held power tool, are distributed uniformly over an angular range that is defined by an entire circumference of the circular arrangement, are configured to define a plurality of different, adjacent rotary positions, relative to the drive shaft of the hand-held power tool, and comprise at least one slaving face that is flat.

10. The blade as recited in claim 9, wherein the blade form-locking elements are spaced apart from the blade centering element.

11. The blade as recited in claim 9, wherein there are twelve blade form-locking elements for corresponding to twelve drive shaft form-locking elements.

12. The blade as recited in claim 9, wherein the adjacent rotary positions are separated by 30° intervals.

13. The blade as recited in claim 9, wherein a diameter of the blade centering element amounts to 6 mm for corresponding to a diameter of the drive shaft.

14. The blade as recited in claim 9, wherein a bearing face on the fastening portion on which the blade form-locking elements are disposed corresponds to a slaving face of a flange on which the drive shaft form-locking elements are disposed.

15. The blade as recited in claim 9, wherein a radius of the blade form-locking elements is four times as large as a radius of the blade centering element.

16. The blade as recited in claim 9, wherein the blade form-locking elements are embodied as raised bulges that engage recesses on the drive shaft.

17. A blade for mounting on a drive shaft of a hand-held power tool, the tool compromising:

a working portion; and a fastening portion including blade form-locking elements for axial mounting and fastening the blade onto a drive shaft of the hand-held power tool; and a blade centering element configured to center the blade relative to the drive shaft of the hand-held power tool, the blade centering element is embodied as an opening that passes through the blade;

wherein the fastening portion forms a first blade part arranged in parallel to the working portion, which forms a second blade part;

wherein the second blade part is permanently connected to the first blade part via an inclined section of the blade;

wherein said blade form-locking elements are located radially outside said blade centering element in a circular arrangement, are defined as openings that pass through the blade, have a quadrangular cross section for corresponding to a trapezoidal cross section of flange form-locking elements of the hand-held power tool, are distributed uniformly over an angular range that is defined by an entire circumference of the circular arrangement, are configured to define a plurality of different, adjacent rotary positions, relative to the drive shaft of the hand-held power tool, and blade fastening portion, are spaced apart from the circular blade centering element and comprise at least one slaving face that is flat.

18. The blade as recited in claim 17, wherein there are twelve blade form-locking elements for corresponding to twelve drive shaft form-locking elements.

19. The blade as recited in claim 17, wherein the adjacent rotary positions are separated by 30° intervals.

20. The blade as recited in claim 17, wherein a diameter of the blade centering element amounts of 6 mm for corresponding to a diameter of the drive shaft.

21. The blade as recited in claim 17, wherein a bearing face on the fastening portion on which the blade form-locking elements are disposed corresponds to a slaving face of a flange on which the drive shaft form-locking elements are disposed.

22. The blade as recited in claim 17, wherein a radius of the blade form-locking elements is four times as large as a radius of the blade centering element.

23. The blade as recited in claim 17, wherein the blade form-locking elements are embodied as raised bulges that engage recesses on the drive shaft.

* * * * *